US006913190B2

(12) United States Patent
Ruhbusch et al.

(10) Patent No.: US 6,913,190 B2
(45) Date of Patent: Jul. 5, 2005

(54) RECLOSABLE CONTAINER WITH AUTOMATIC CLOSURE SYSTEM

(75) Inventors: Todd R. Ruhbusch, Holmen, WI (US); Natalie G. Casey-Shuman, Pittsfield, NH (US); Michael L. Roy, Sanbornton, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/622,925

(22) Filed: Jul. 17, 2003

(65) Prior Publication Data

US 2005/0011941 A1 Jan. 20, 2005

(51) Int. Cl.[7] ..... B65D 17/28; B65D 5/66

(52) U.S. Cl. ..... 229/225; 229/145; 229/148; 229/905

(58) Field of Search ..... 229/125.27, 145, 229/148, 224, 225, 226, 227, 228, 905

(56) References Cited

U.S. PATENT DOCUMENTS

| | | | | | |
|---|---|---|---|---|---|
| 2,957,617 | A | * | 10/1960 | Bolding | 229/145 |
| 3,195,798 | A | * | 7/1965 | Wilson | 229/125.27 |
| 3,310,223 | A | * | 3/1967 | Buttery | 229/145 |
| 3,357,631 | A | * | 12/1967 | Aid et al. | 229/149 |
| 3,454,212 | A | * | 7/1969 | Elward | 229/228 |
| 3,478,953 | A | * | 11/1969 | Chapman et al. | 229/228 |
| 4,046,313 | A | * | 9/1977 | Perry | 229/227 |
| 4,048,052 | A | * | 9/1977 | Tolaas | 229/224 |
| 4,314,643 | A | * | 2/1982 | Forbes, Jr. | 229/145 |
| 5,154,343 | A | * | 10/1992 | Stone | 229/225 |
| 5,314,114 | A | * | 5/1994 | Stone | 229/225 |
| 5,511,722 | A | * | 4/1996 | Dixon | 229/225 |
| 5,947,368 | A | | 9/1999 | Thresher et al. | 229/208 |
| 6,105,856 | A | | 8/2000 | Kakiuchi | 229/148 |

* cited by examiner

*Primary Examiner*—Gary E. Elkins
(74) *Attorney, Agent, or Firm*—Womble Carlyle Sandridge & Rice, PLLC

(57) ABSTRACT

A reclosable container made of a semi-rigid paperboard material or the like has a lower component with a bottom panel and an upstanding side wall and an upper component or lid that is pivotally connected to the lower component along one edge thereof. An opposite edge of the lid component has a tab formed therein which can be punched out and folded inwardly relative to the lid to releasably engage a horizontal extension or catch formed along the corresponding top edge of the lower component of the container.

14 Claims, 13 Drawing Sheets

RECLOSABLE CONTAINER WITH AUTOMATIC CLOSURE SYSTEM

BACKGROUND OF THE INVENTION

1. Field of the Invention

The present invention relates generally to reclosable containers which are formed from blanks of semi-rigid paperboard, and more particularly to such a container having an automatic closure system.

2. Description of the Relevant Art

Many containers made from a semi-rigid material such as paperboard are formed from blanks of the paperboard material on which fold and score lines have been placed to facilitate the assembly of the container. Many of the containers so formed have a lower component in which a consumer product or the like may be positioned and a lid or upper component that may or may not be pivotally connected to the lower component.

Some containers formed from blanks of paperboard material are re-closable, i.e. the lid may be pivotally opened or removed from the lower component, but repositioned on the lower component in a releasable manner so that the container is temporarily closed but can be reopened at will. Some closure systems merely comprise friction fits between the upper and lower components of the container while others have releasable catches for releasably securing the upper component in a closed position on the lower component. Closure systems vary in complexity of manufacture as well as ease of operation, and some of necessity have relatively high manufacturing costs associated therewith.

An example of one closure system is disclosed in the Kakiuchi, U.S. Pat. No. 6,105,856, where the lid of a cigarette container is hingedly connected to a lower component along one edge with the opposite free edge of the lid having an inwardly and upwardly directed fold that is adapted to releasably catch a downwardly opening hook along a corresponding edge of the lower component.

Another example of a closure system for a re-closable container is disclosed in U.S. Pat. No. 5,947,368 issued to Thresher et al. In the Thresher et al. patent, there are various closure systems disclosed with one comprising a horizontal ledge projecting outwardly from the top edge of the lower component of the container with the ledge being adapted to cooperate with an inwardly folded corresponding lower edge of the container lid. The inwardly folded edge of the lid is adapted to pass beyond and catch on the horizontal ledge for releasably holding the lid in a closed position.

While there are numerous other closure systems in the art, there are unique problems associated therewith and, accordingly, the need for improved closure systems is prevalent. It is to meet this need that the present invention has been developed.

SUMMARY OF THE INVENTION

The present invention provides a simplified but unique releasable closure system for use on semi-rigid paperboard containers wherein the container includes a lower component and an upper component or lid that may be pivotally connected to the lower component.

The lower component includes a bottom panel and an upstanding sidewall, with the sidewall defining an upper edge and wherein a horizontal extension or catch protrudes outwardly a short distance from the upper edge. The horizontal extension is adapted to cooperate with a punch-through tab on a corresponding flange of the lid. The tab is defined in the flange of the lid by an upper fold line and a perforated line along the remainder of the tab edge so that the perforated edge can be severed and the tab folded inwardly along the fold line whereby at least a portion of the severed edge is directed upwardly and in a position to releasably catch and engage a bottom surface of the horizontal extension.

It will be appreciated that since the container is preferably made of a semi-rigid paperboard material or the like, the inwardly folded tab flexes as it passes the catch during closure of the lid, but can be easily released by inserting one's finger into the opening left by the punched-out tab and pulling the tab away from the catch.

Other aspects, features and details of the present invention can be more completely understood by reference to the following detailed description of the preferred embodiment, taken in conjunction with the drawings and from the appended claims.

DESCRIPTION OF THE PREFERRED EMBODIMENT

The container 30 (FIG. 15) of the present invention is preferably made from a flat blank 32 (FIGS. 1–3 and 8) of a semi-rigid paperboard material even though suitable alternatives would be known to those skilled in the art. The blank of paperboard material is cut into the configuration shown in FIG. 1 and various score lines and fold lines are formed in the blank in a conventional manner to define various integrated elements which form panels, tabs or flanges of the completed container when foldably assembled in a manner to be described hereafter.

Figure 1:
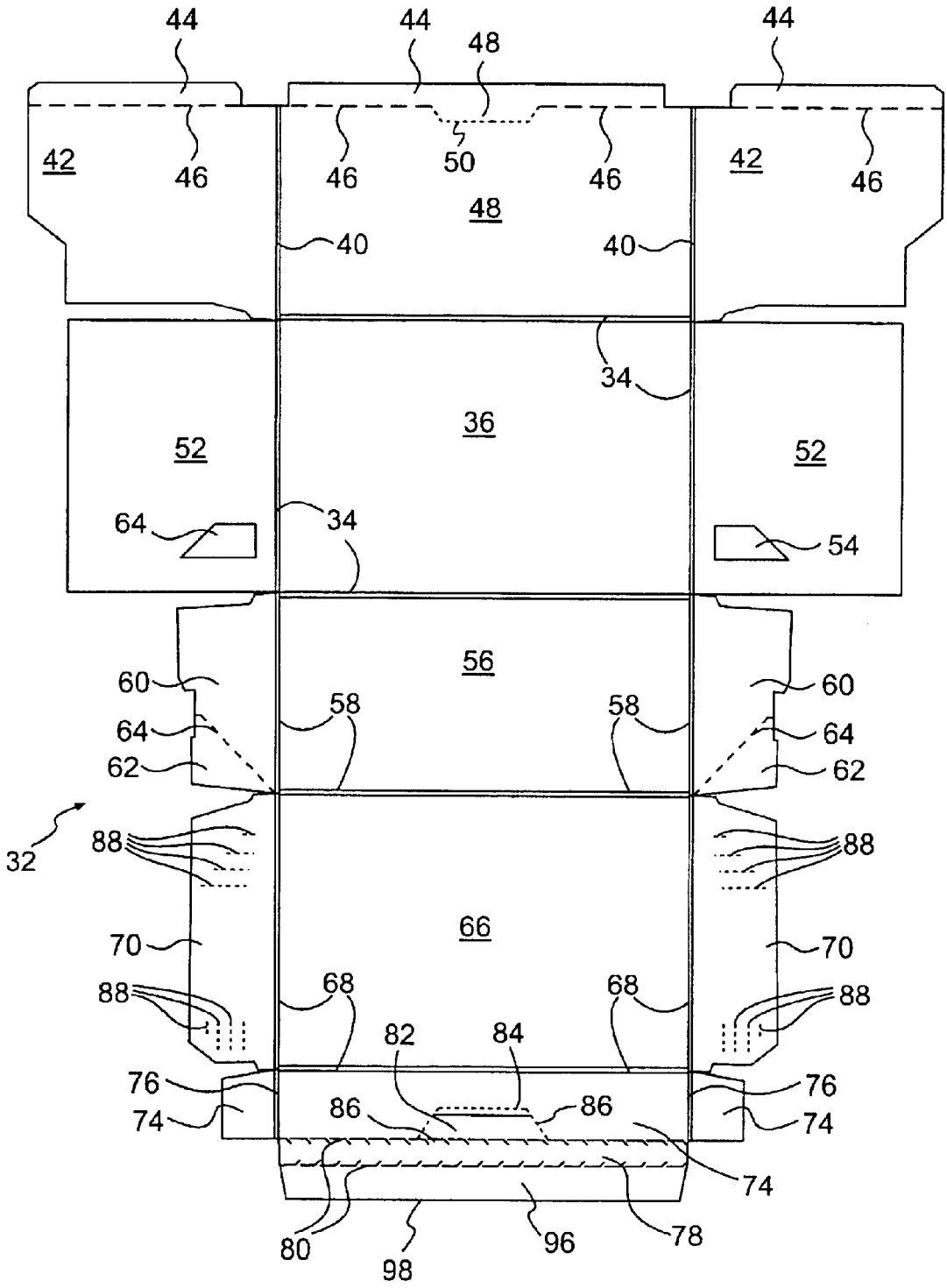
FIG. 1 is a plan view of a blank from which the container of the present invention is formed.
Figure 5:
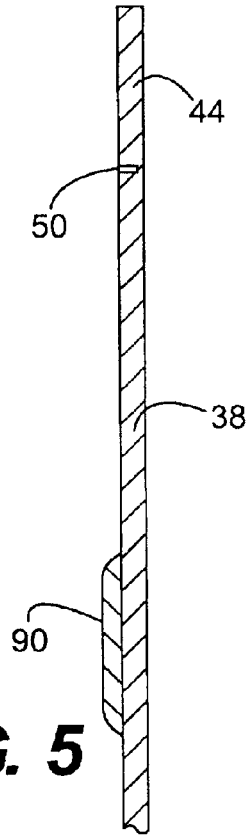
FIG. 5 is an enlarged fragmentary section taken along line 5—5 of FIG. 2.

The flat blank 32 is possibly best seen in FIG. 1 as having four mutually perpendicular fold lines 34 surrounding a bottom panel 36 of quadrilateral configuration which in the present disclosure is rectangular even though it will be appreciated that other shapes would also be contemplated within the invention. Adjacent to the bottom panel, a rectangular front panel 38 is also formed by a pair of fold lines 40 that cooperate with a fold line 34 of the bottom panel. The front panel has end flaps 42 defined on opposite sides of the fold lines 40. Along a common edge of the front panel 38 and its associated end flaps 42, three edge panels 44 are defined by broadly spaced perforations 46 so that the edge panels can be folded relative to the front panel and its associated end flaps and can also be removed therefrom by tearing along the perforations, if desired. The edge panel 44 associated with the front panel 38 has a trapezoidal extension 48 into the front panel, which will be alternately referred to hereafter as a catch, with the catch being defined by a closely perforated line 50. It is important to note the perforations in line 50, as seen in FIG. 5 of the disclosed embodiment, do not extend totally through the blank material, for a purpose to be described later, even though they could depending upon the intended use of the container. The perforated line will partially or fully sever, depending on the depth of the perforations, when the edge panel associated with the front panel is folded relative to the front panel as will be described later.

End panels 52 are also formed at opposite ends of the bottom panel 36 and are separated from the bottom panel by the fold lines 34. Each end panel 52 also has a truncated rectangular area 54 that is raised slightly to accommodate folding and gluing of other component parts of the container as will become apparent hereafter.

On the opposite side of the bottom panel 36 from the front panel 38, a rear panel 56 is defined by three fold lines 58 and the fold line 34 separating the bottom panel from the rear panel. Rear panel tabs 60 are also formed along opposite ends of the rear panel and separated from the rear panel by associated fold lines 58. Each rear panel tab also has a removable generally triangular shaped section 62 defined by a perforated tear line 64, the function for which will become apparent later.

A top panel 66 is defined adjacent to the rear panel 56 and also has three fold lines 68 extending therearound with the top panel being separated from the rear panel by one of the fold lines 58. The top panel has end flanges 70 defined at its opposite ends on opposite sides of the associated fold lines 68 and a front flange 72 on the opposite side of a fold line 68. The front flange 72 has end tabs 74 on opposite sides of associated fold lines 76 and further has a tear strip 78 parallel to a fold line 68 along the front edge of the top panel and spaced therefrom. The tear strip has perforations 80 along opposite sides so it can be severed from the rest of the flange in a conventional manner. A latch tab 82 of generally trapezoidal configuration is defined in the front flange 72 of the top panel by a fold line 84 along a top edge of the tab and a pair of downwardly divergent perforated lines 86 which intersect a perforation 80 of the tear strip. The latch tab can therefore be punched through by severing the perforated edges of the tab and folding the tab along the fold line 84.

The end flanges 70 of the top panel have closely spaced parallel perforated lines 88 formed therein on which adhesive is applied as will be described hereafter.

Figure 2:
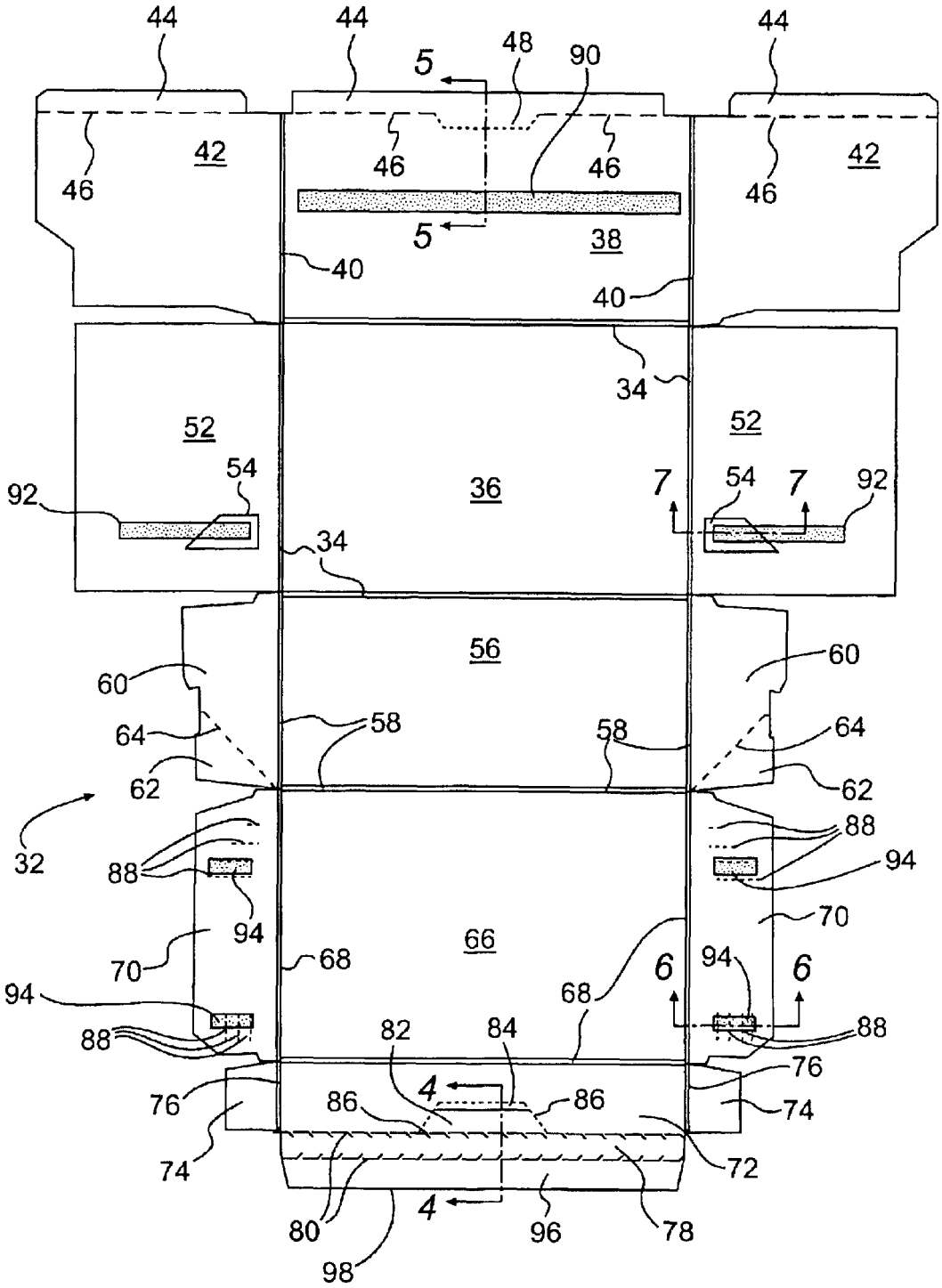
FIG. 2 is a plan view similar to FIG. 1 after glue has been applied to certain locations on the blank.
Figure 3:
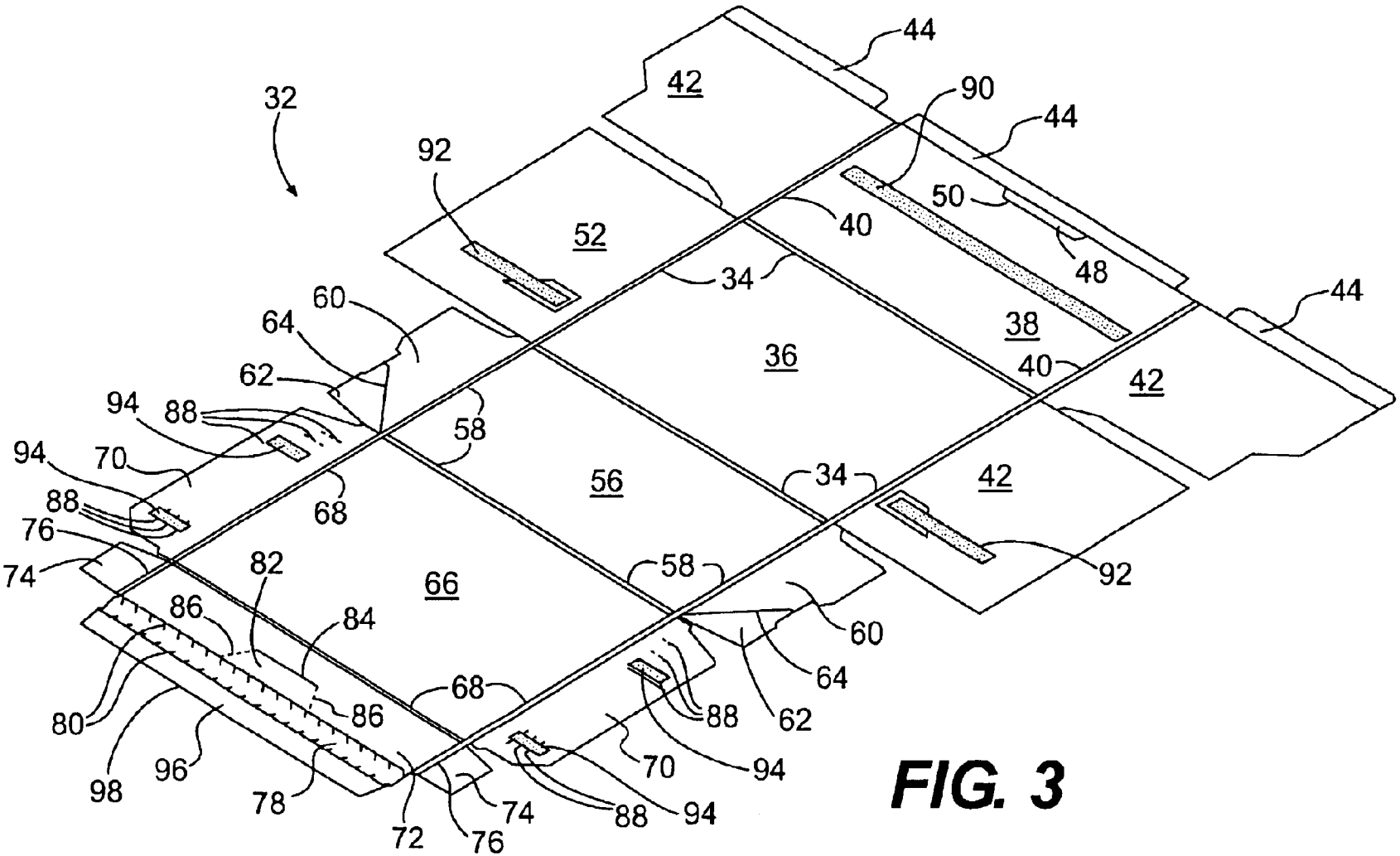
FIG. 3 is an isometric view looking downwardly on the panel as shown in FIG. 2.

As shown best in FIGS. 2 and 3, prior to forming the container 30 from the blank 32 shown in FIG. 1, adhesive strips are applied to the panel with the adhesive being of any known type used in the formation of containers. A long adhesive strip or line 90 is placed on the front panel 38 spaced from and parallel to its longitudinal edges. Strips 92 of adhesive are also applied to the end panels 52 associated with the bottom panel 36 so as to overlie the raised truncated rectangular areas 54 as well as an area adjacent thereto. Small adhesive strips 94 are applied to the end flanges 70 associated with the top panel 66 in the area of the closely spaced parallel perforated lines 88.

Figure 4:
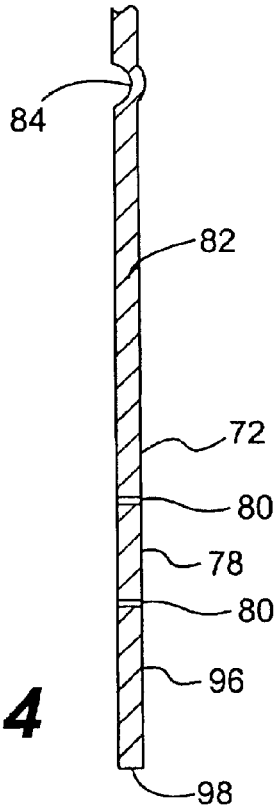
FIG. 4 is an enlarged fragmentary section taken along line 4—4 of FIG. 2.
Figure 6:
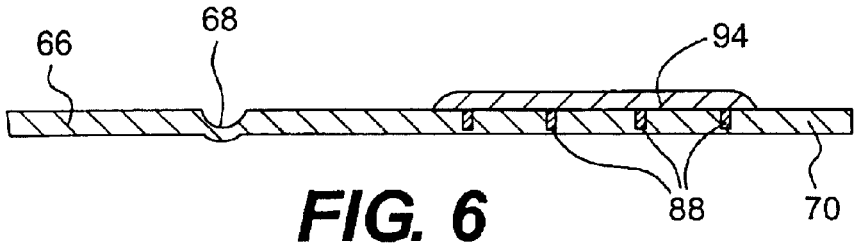
FIG. 6 is an enlarged fragmentary section taken along line 6—6 of FIG. 2.
Figure 7:
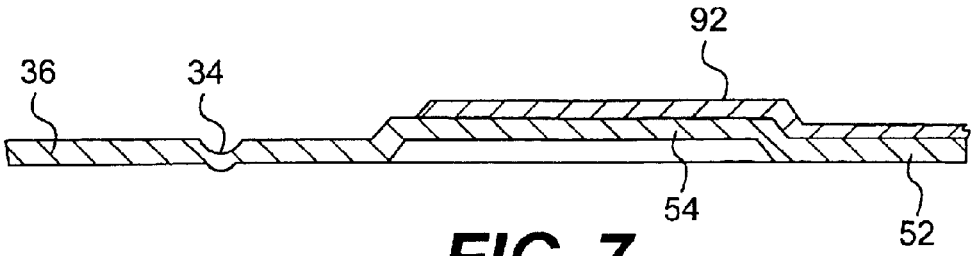
FIG. 7 is an enlarged fragmentary section taken along line 7—7 of FIG. 2.

FIG. 4 is a section taken along line 4—4 of FIG. 2 where the front flange 72 of the top panel 66 is seen to include the perforations 80 along opposite sides of the tear strip 78 and the fold line 84 along the top edge of the latch tab 82. FIG. 5 shows the edge panel 44 associated with the front panel 38 and the perforations 46 therein that form the catch or horizontal extension 48 when the container is folded. FIG. 5 also shows the strip 90 of adhesive that is applied thereto. FIG. 6 is a section through an end flange 70 of the top panel 66 where a fold line 68 separating the top panel from the end flange is seen as well as the line 94 of adhesive and the underlying perforation on which it is applied. FIG. 7 shows the raised truncated rectangular area 54 of an end panel 52 adjacent to the bottom panel 36 with the adhesive 92 applied thereto and the fold line 34 that separates the bottom panel from the end panel.

Figure 8:
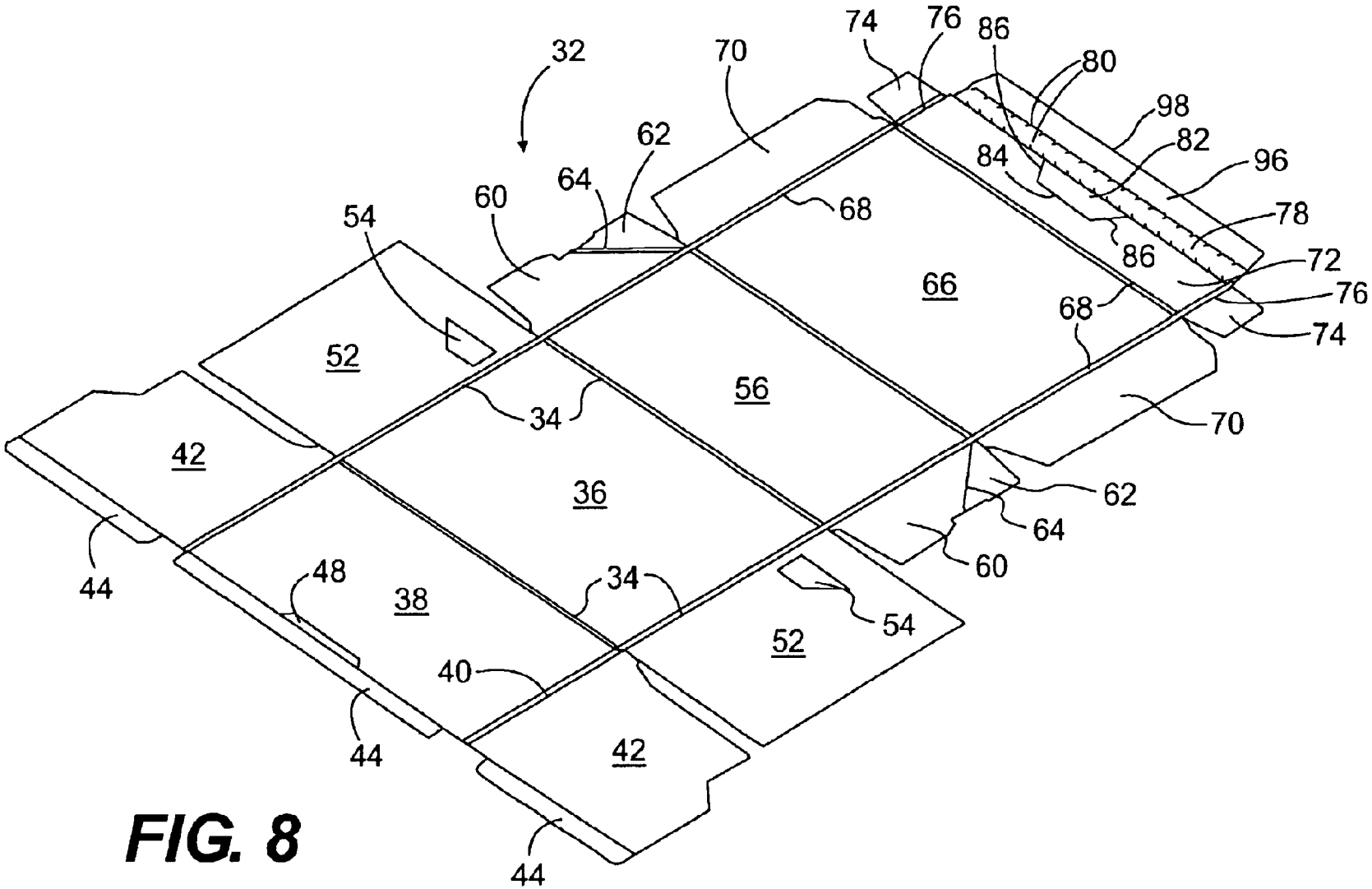
FIG. 8 is an isometric view similar to FIG. 3 looking at the reverse side of the blank.

FIG. 8 illustrates the reverse side of the blank 32 as shown in FIG. 3 and it will be appreciated that no adhesive is applied to the reverse side of the panel. The reverse side of the panel becomes the inside of the container so that any desired visible graphics placed on the container are placed on the side illustrated in FIG. 3.

Figure 9:
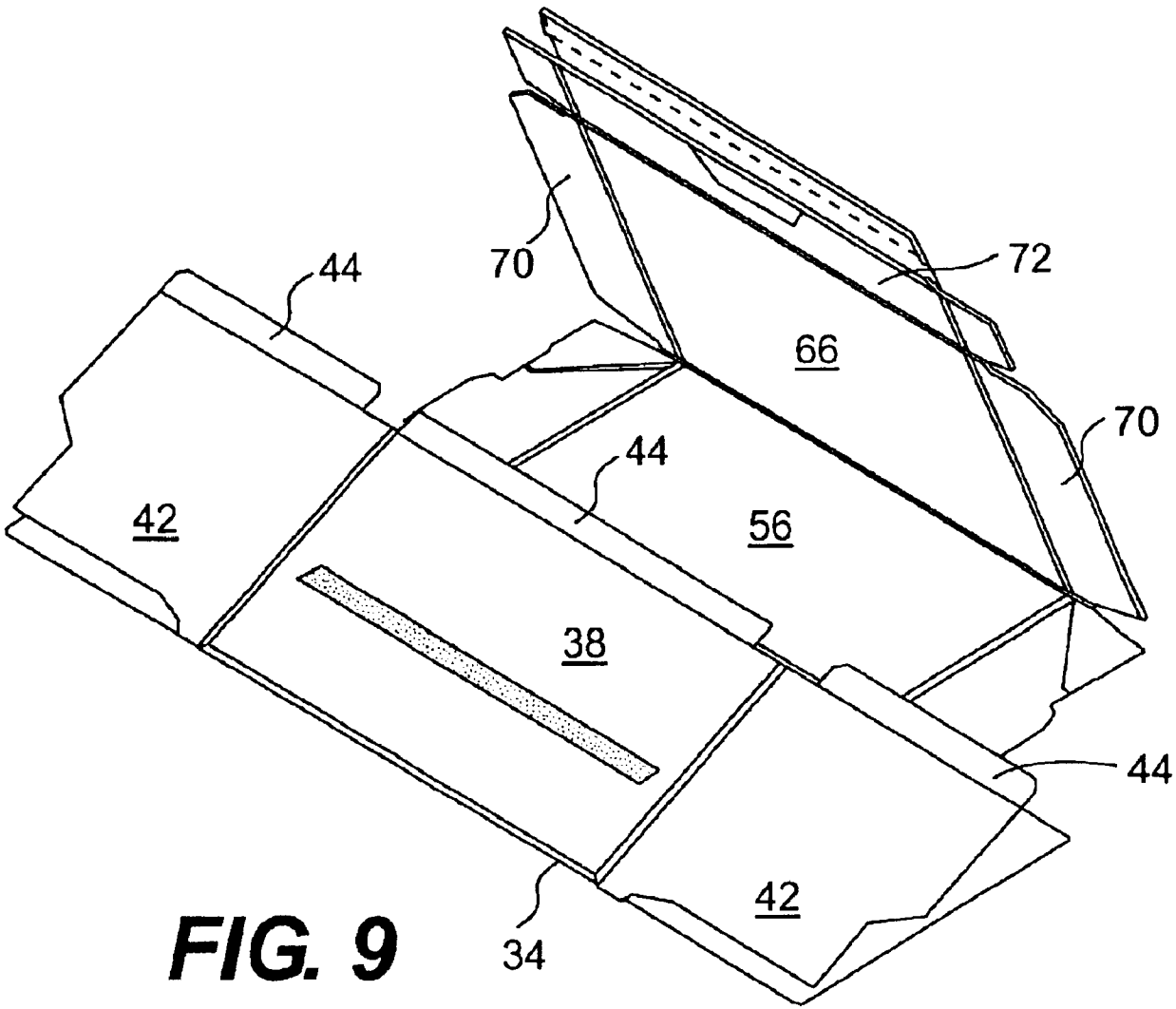
FIG. 9 is an isometric view showing a top panel of the container being folded over a rear panel and a front panel of the lower component of the container being folded over the bottom panel of the container.

When forming the container from the blank, as shown in FIG. 8, the front panel 38 with its associated end flaps 42 is first folded along the fold line 34 separating the front panel from the bottom panel 36 and such that the front panel overlies the bottom panel as seen in FIG. 9. Subsequently, the top panel 66, with its associated flanges 70 and 72, is folded along the fold line 58 separating it from the rear panel 56 so the top panel overlies the rear panel and such that the front flange 72 of the top panel overlies the front panel 38. An outermost portion 96 of the front flange 72 adjacent to a lower edge 98 of the front flange is separated from the top panel 66 and the remainder of the front flange by the tear strip 78 and overlies the adhesive line 90 on the front panel and is secured thereto under pressure. The secured folded material is illustrated in FIG. 10.

Figure 10:
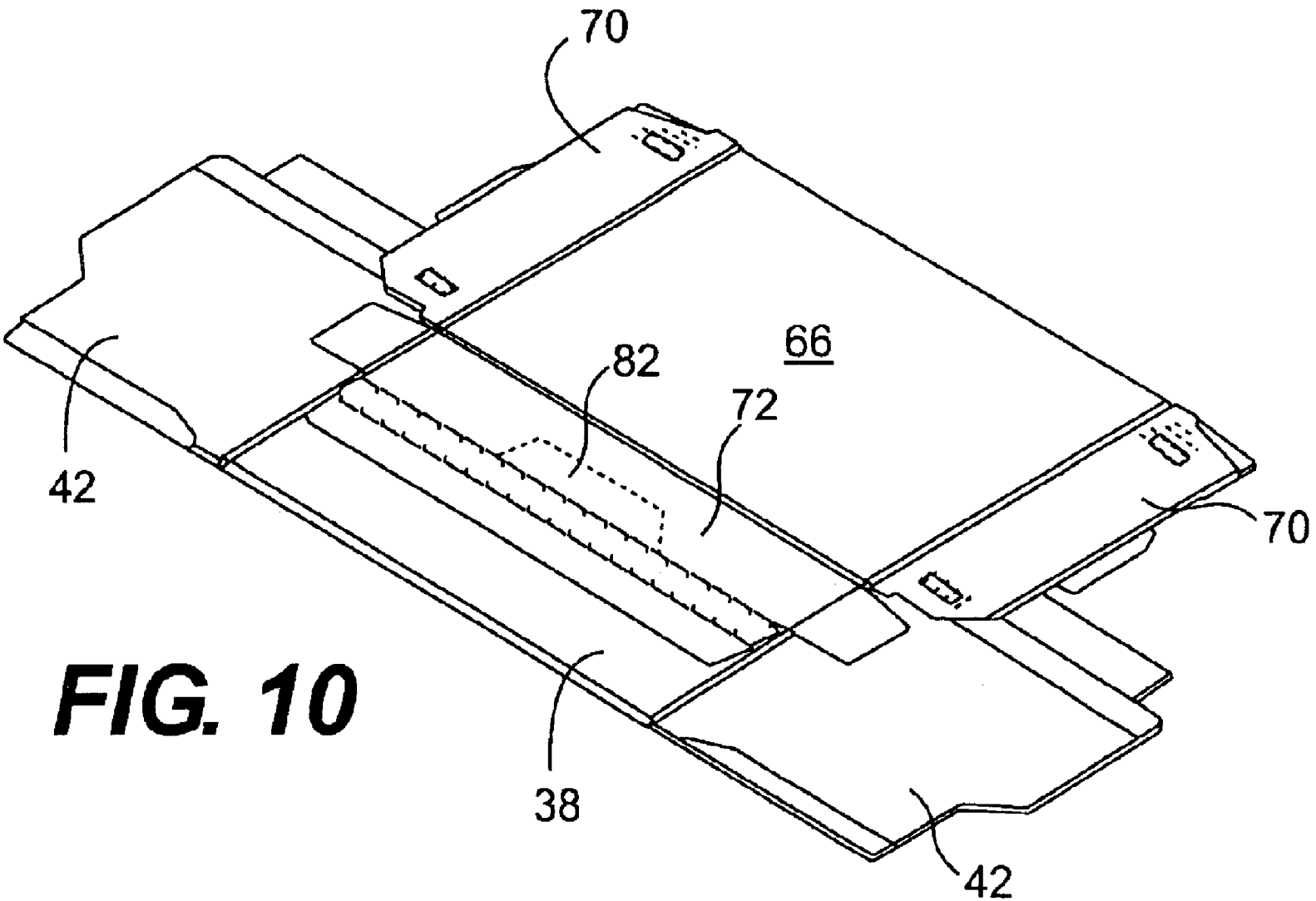
FIG. 10 is an isometric view similar to FIG. 9 with the front flange of the top panel having been adhesively secured to the front panel of the lower component of the container.
Figure 11:
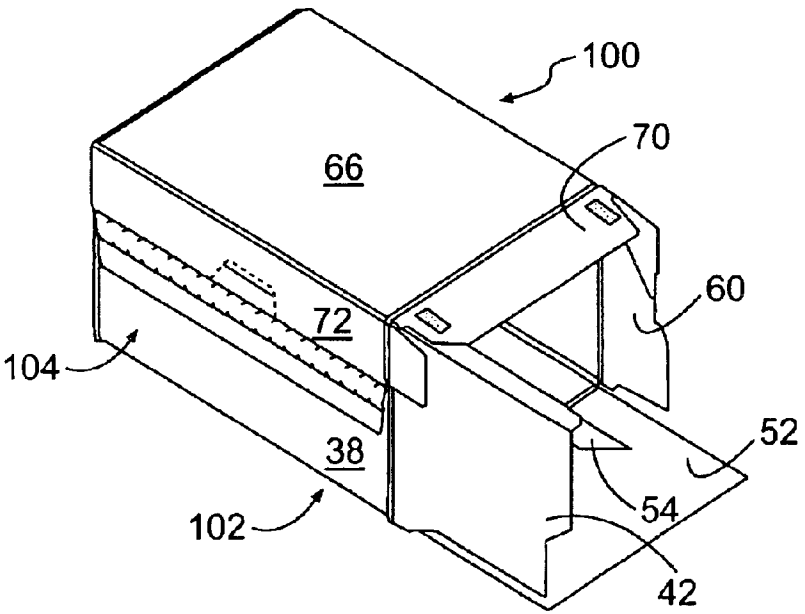
FIG. 11 is an isometric view wherein the container as folded in FIG. 10 has been expanded into a three dimensional orientation and one end of the container has been closed and sealed in a manner similar to that shown in FIGS. 11–15.

After the panel blank 32 has been folded and glued as shown in FIG. 10, the fold line 34 between the front panel 38 and the bottom panel 36 is moved toward the fold line 58 between the top panel 66 and the rear panel 56 causing the flat folded form of the container in FIG. 10 to expand into a three dimensional form as substantially shown in FIG. 11. In other words, the front 38 and rear 56 panels become oriented perpendicularly to the top 66 and bottom 36 panels and the edge panels 44 associated with the front panel 38 and the front panel end flaps 42 are automatically folded inwardly beneath and in parallel relationship with the top panel 66. As the edge panel 44 associated with the front panel 38 folds beneath the top panel, the catch is severed from the front panel along the perforated line 50 and extends coplanar with the edge panel 44 but in an opposite direction. In the disclosed embodiment, as mentioned previously, the perforations in line 50 do not extend totally through the blank material and as a result, when the edge panel 44 associated with the front panel 38 folds beneath the top panel, the material within the perforated lines is only partially severed from the front panel as the front panel actually delaminates within the perforated line so that not only is the catch 48 itself formed so as to extend coplanar with the edge panel 44 but in an opposite direction, but a layer of relatively thin material remains in the front panel within the perforated line 50. The catch in this instance is thinner than the semi-rigid material from which the container is made. This is important if the container is being used to confine materials that may be liquid in some state, such as ice cream. If the container on the other hand is not being used to contain materials that would be liquid in some state, the perforations in the line 50 can extend completely through the blank material so that the perforated line 50 is fully severed when the edge panel 44 associated with the front panel 38 folds beneath the top panel. In such an instance, there will obviously be a hole or opening through the front panel that the catch had previously occupied and the catch would be of the same thickness as the semi-rigid material.

As viewed in FIG. 11, the end of the container toward the top is shown fully folded with the end toward the bottom remaining open. It will be appreciated, however, that both ends are folded according to the same procedure with only the folding of the bottom end being illustrated in FIGS. 11–15 and described hereinafter.

Figure 12:
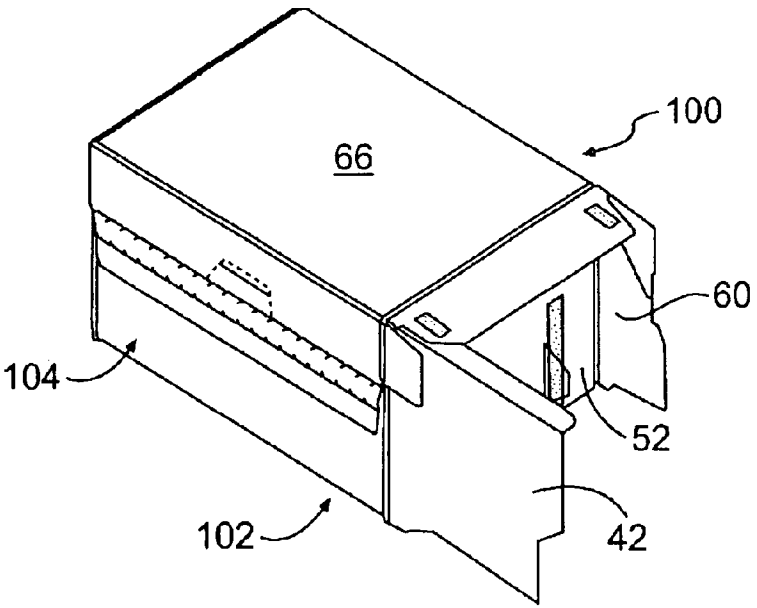
FIG. 12 is an isometric similar to FIG. 11 wherein an end panel of the lower component of the container has been folded upwardly.
Figure 14:
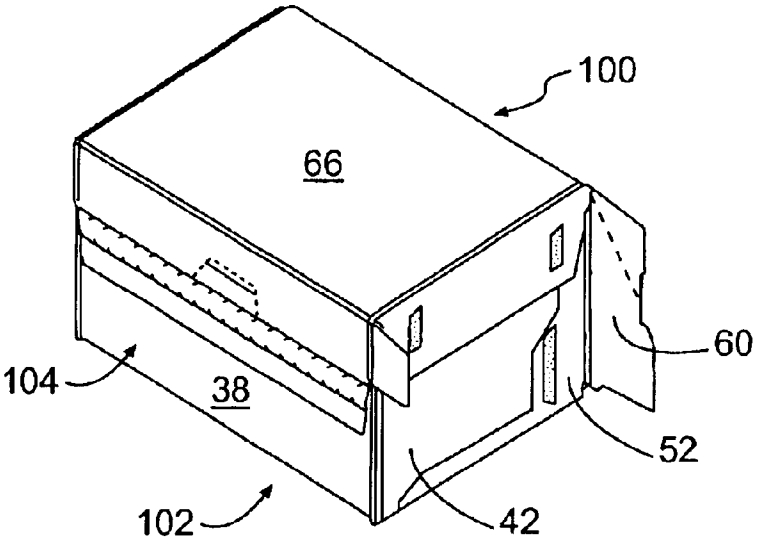
FIG. 14 is an isometric similar to FIG. 13 wherein a flange of the top panel has been folded downwardly overlying the end flap of the front panel.
Figure 13:
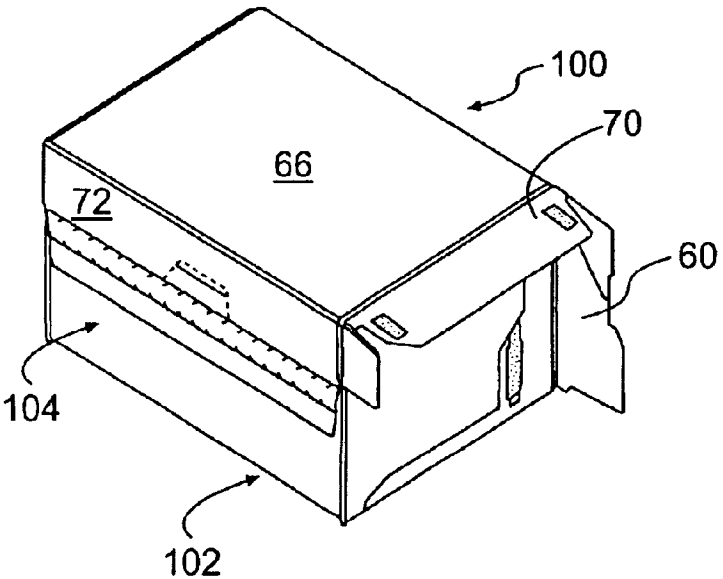
FIG. 13 is an isometric similar to FIG. 12 wherein an end flap of the front panel of the lower component has been folded inwardly over the previously folded end panel.
Figure 15:
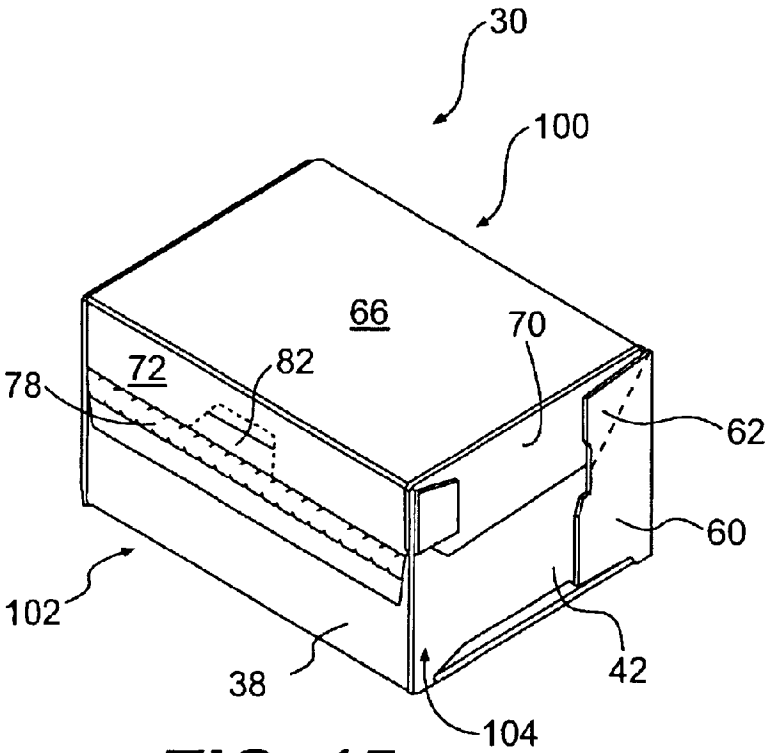
FIG. 15 is an isometric similar to FIG. 14 wherein tabs on the front and rear panel of the lower component have been folded and secured to the previously folded flange of the top panel.
Figure 17:
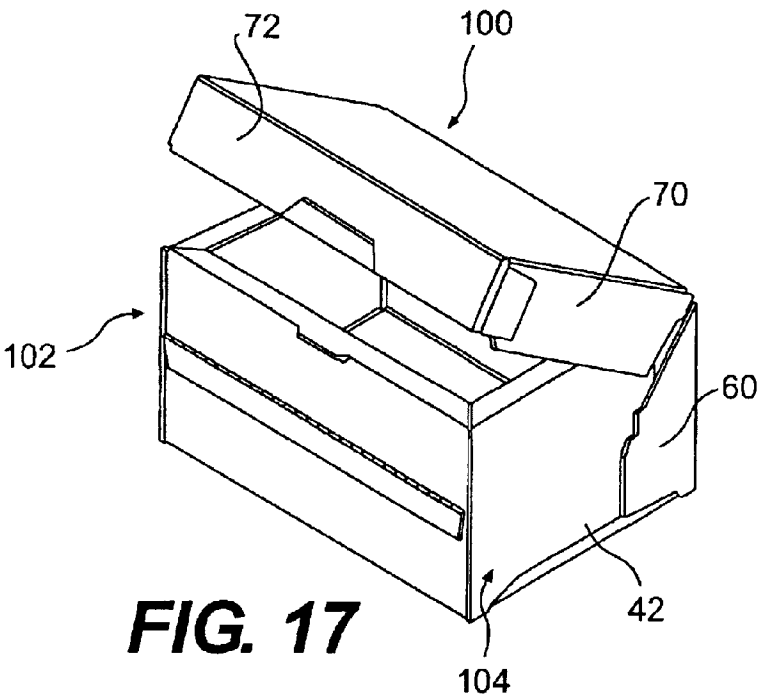
FIG. 17 is an isometric similar to FIG. 16 with the upper component having been partially pivotally opened.
Figure 20:
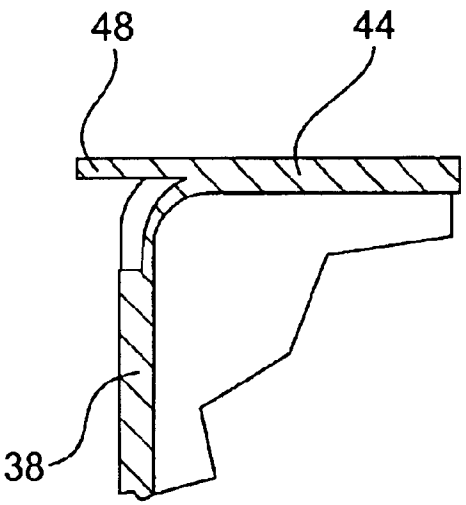
FIG. 20 is an enlarged fragmentary section taken along line 20—20 of FIG. 18.

Referring to FIG. 11, in order to close an end of the container, the end panel 52 which is separated from the bottom panel 36 by the fold line 34 is first folded upwardly so as to be positioned perpendicularly to the top and bottom panels as seen in FIG. 12. Subsequently, the end flap 42 which is separated from the front panel 38 by the fold line 40 is folded inwardly into overlying relationship with the end panel 52 as illustrated in FIG. 13. The end flange 70 associated with the top panel 66 and separated therefrom by the fold line 68 is next folded downwardly into overlying relationship with a top edge of the end flap 42 as seen in FIG. 14. Finally, the associated tabs 74 at opposite ends of the front flange of the top panel are folded inwardly to be adhesively secured to the end flange 70 of the top panel and the tabs 60 at opposite ends of the rear panel are folded inwardly for engagement with the adhesive 94 on the flanges 70 of the top panel as seen in FIG. 15. The end tab 60 of the rear panel can be seen to not only adhesively engage the adhesive strip 94 on the end flange of the top panel but also the adhesive strip 92 on the end panel 52 associated with the bottom panel so that the entire container is fully closed and adhesively retained in the assembled form of FIG. 15. As mentioned previously, as the container 30 is being formed, the edge panels 44 along the front panel 38 and its end flaps 42 are automatically folded inwardly so as to define a horizontal shelf that might partially overlie any product 42 within the container with the horizontal shelf probably being best seen in FIGS. 17 and 18. It will also be seen that as the edge panel 44 associated with the front panel 38 is folded inwardly, as mentioned previously the catch or trapezoidal extension 48 which is coplanar with the remainder of the edge panel 44 severs or partially severs itself along the perforated line 50 and extends forwardly or outwardly in a horizontal manner a small distance from the front panel 38 of the container. This is also seen in FIGS. 17 and 18.

Figure 16:
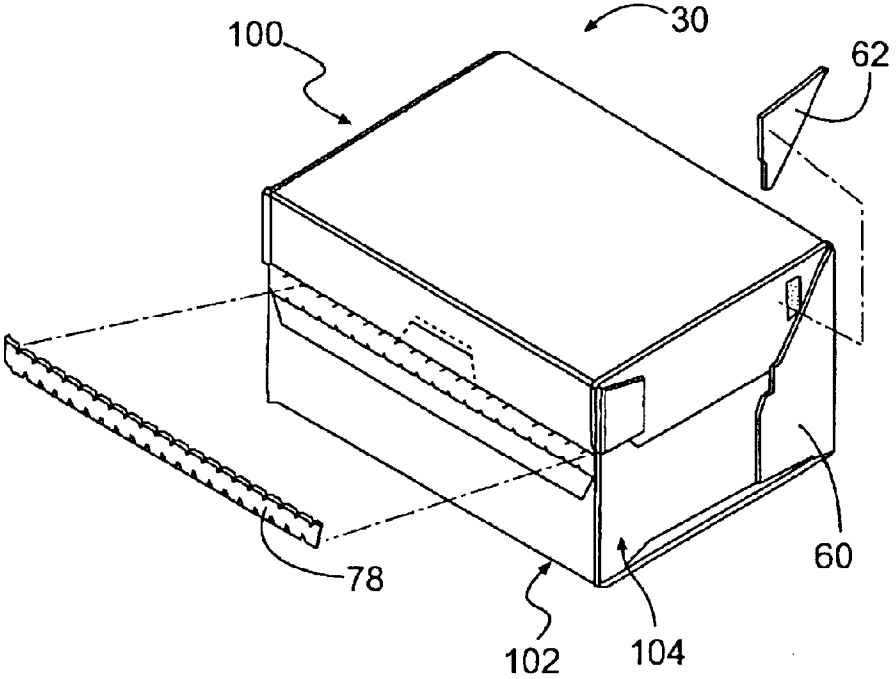
FIG. 16 is an isometric similar to FIG. 15 wherein pull tabs have been removed to allow the upper component to be pivoted relative to the lower component out of the closed position.

To open the container 30, the triangular sections 62 on the end tabs 60 of the rear panel 56 are first severed and torn away from the container as illustrated in FIG. 16 even though it will be appreciated the remainder of the end tabs 60 of the rear panel remain adhesively secured to the ends of the container. Also, the tear strip 78 is removed by severing the perforated lines 80 on either side thereof and as will be appreciated this leaves the upper portion or lid 100 of the container free to flex or pivot about the fold line 58 which becomes a living hinge separating the top panel 66 from the rear panel 56. The lid is therefore hingedly connected to a lower component 102 of the container as best shown in FIGS. 17 and 18 with the lower component having a side wall 104 comprised of the front 38 and rear 56 panels as well as the laminates at opposite ends of the container which extend perpendicularly upwardly from the bottom panel.

Figure 18:
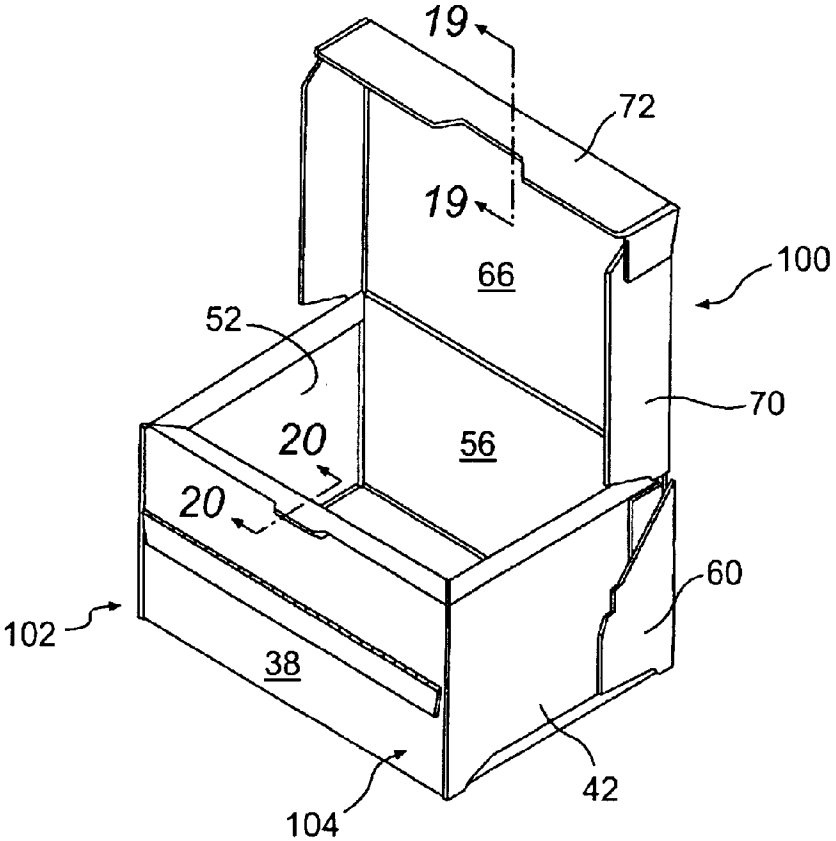
FIG. 18 is an isometric similar to FIG. 17 with the upper component having been fully opened.
Figure 19:
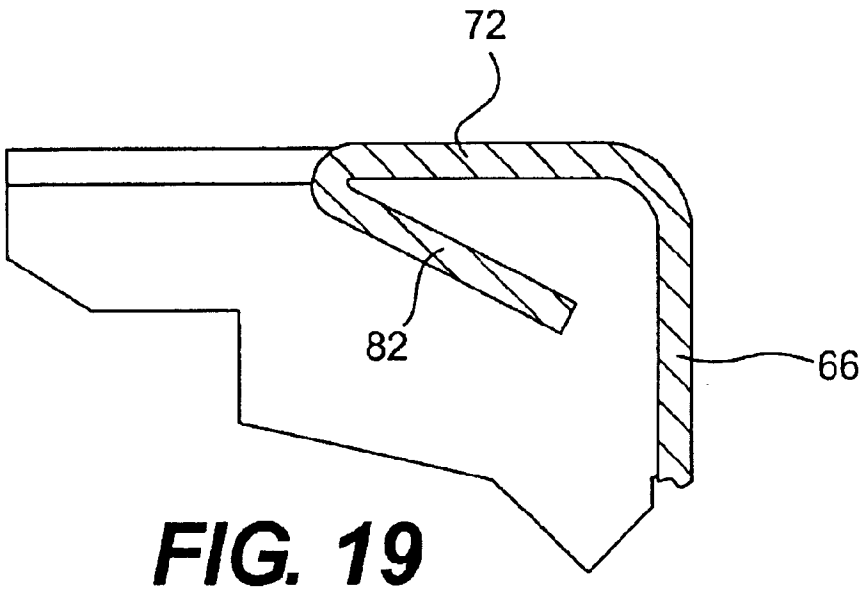
FIG. 19 is an enlarged fragmentary section taken along line 19—19 of FIG. 18 showing the inwardly folded tab on the upper component.
Figure 22:
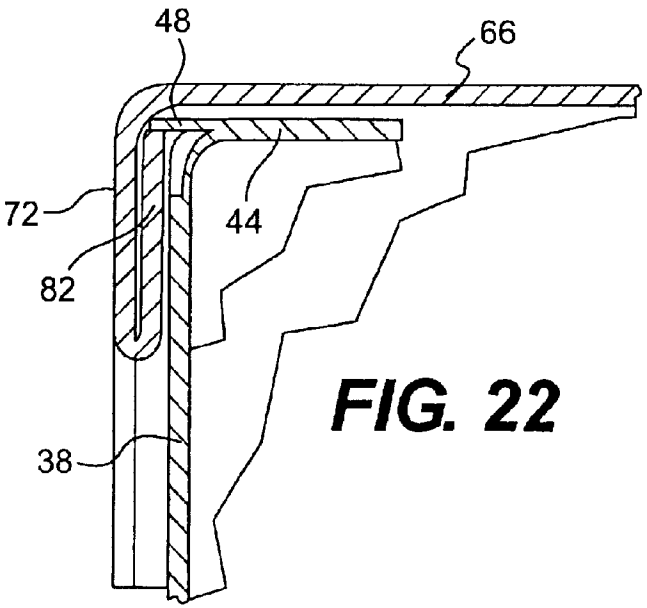
FIG. 22 is an enlarged fragmentary section taken along line 22—22 of FIG. 21.
Figure 21:
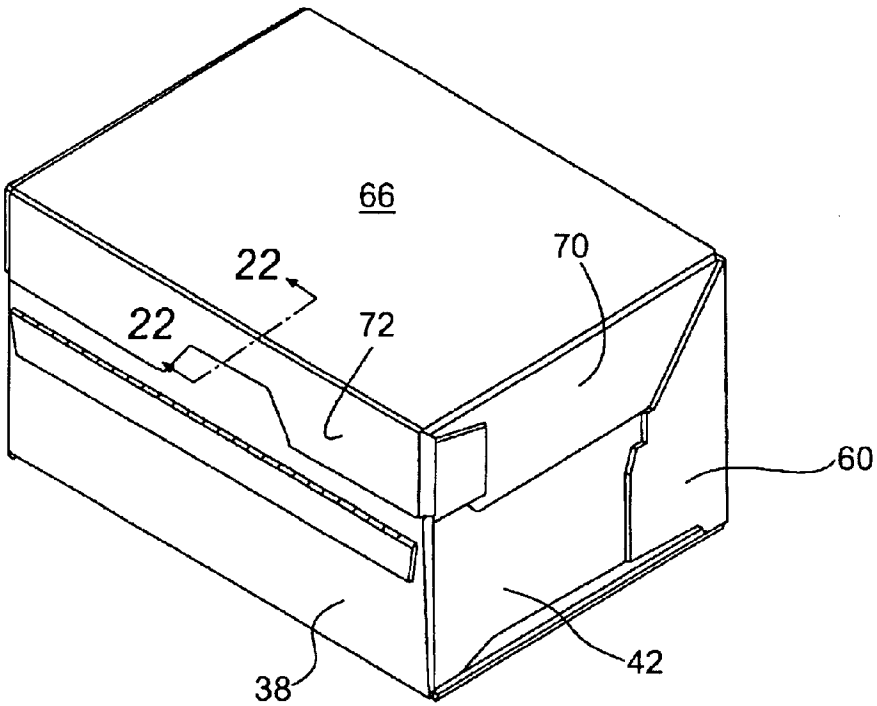
FIG. 21 is an isometric showing the container having been re-closed with the folded tab of the upper component engaging the catch of the lower component.

A user of the container therefore has access to the interior of the container with the lid 100 in its pivotally opened position of FIG. 18 but the lid can be obviously closed again by pivoting the lid downwardly so that the front flange 72 of the lid overlies the front panel 38 of the lower component 102 of the container. The lid can be releasably secured in its closed position by folding the latch tab 82 inwardly about its upper fold line 84 as probably seen best in FIG. 19 so that the free or remaining edge of the tab projects upwardly when the lid is closed as probably best seen in FIG. 22. The latch tab slidably engages the catch or horizontal extension 48 on the front panel 38 when the lid is being closed but due to the flexible nature of the semi-rigid material from which the container is made, the latch tab is urged against the inner surface of the front flange by the catch 48 and once the free upper edge of the latch tab passes the catch, it springs back underneath the catch as shown in FIG. 22 making an audible "snap" and releasably retains the lid in a closed position relative to the lower component of the container. Of course to reopen the container, an operator simply inserts his or her finger into the opening in the front flange 72 that was previously occupied by the latch tab before it was folded and the front flange can then be pulled outwardly or forwardly releasing the tab from beneath the catch so that the lid can be opened.

Although the present invention has been described with a certain degree of particularity, it is understood that the disclosure has been made by way of example, and changes in detail or structure may be made without departing from the spirit of invention as defined in the appended claims.

What is claimed is:

1. A reclosable container formed from a semi-rigid material comprising in combination:

a lower component having a bottom panel and a side wall connected to and projecting upwardly from the bottom panel, said side wall having an upper edge and a catch defined by a substantially perpendicular extension from said side wall along said upper edge, said extension having a bottom surface, and an upper component adapted to overlie the lower component, said upper component having a top panel with a downwardly directed flange, said flange having an integrated tab formed thereon, said tab having a top edge defined by a fold line, and a remaining edge defined along a perforated line in said flange such that said tab can be folded inwardly along said fold line after said perforated line has been severed such that at least a portion of said remaining edge is directed substantially upwardly and positioned to engage said bottom surface of said extension when said upper component of the container is positioned over said lower component.

2. The container of claim 1 further including a pivotal connection between said upper component and said lower component.

3. The container of claim 2 wherein said pivotal connection is on an opposite side of said container from said catch.

4. The container of claim 3 wherein said flange is secured to said side wall adjacent to said tab and said flange further includes a tear away strip allowing said flange to be separated from said side wall adjacent to said tab.

5. The container of claim 1 wherein said container is formed from a flat blank of said semi-rigid material and wherein said catch is defined within the portion of said blank from which said side wall is formed and has a perforated line defining an edge of said catch which perforated line is at least partially severable to permit said catch to be formed from said side wall when the container is formed from said blank.

6. The container of claim 1 wherein said side wall has four perpendicular panels, each panel of said side wall being perpendicular to said bottom panel and having an panel upper edge which cooperates with the other panel upper edges in forming said upper edge of the lower component in a quadrilateral configuration.

7. The container of claim 6 wherein said upper component includes a quadrilateral top panel and said downwardly directed flange is comprised of three panel flanges, each panel flange disposed perpendicularly to an edge of said top panel with the fourth edge of said top panel defining a hinged connection with an associated one of said panel upper edges.

8. The container of claim 7 wherein said tab is formed in the panel flange opposite said hinged connection.

9. The container of claim 8 wherein said catch is positioned on the panel upper edge opposite said hinged connection.

10. The container of claim 1 wherein said downwardly directed flange has a lower edge and wherein said tab is spaced upwardly from said lower edge.

11. The container of claim 5 wherein the perforations in said perforated line defining an edge of said catch extend only partially through said semi-rigid material.

12. The container of claim 11 wherein said catch is formed from a delaminated layer of said side wall.

13. The container of claim 5 wherein the perforations in said perforated line defining an edge of said catch extend completely through said semi-rigid material.

14. The container of claim 13 wherein said catch is formed from the fill thickness of said side wall.

* * * * *